US007658628B2

(12) United States Patent
Guan et al.

(10) Patent No.: US 7,658,628 B2
(45) Date of Patent: Feb. 9, 2010

(54) CARD EDGE CONNECTOR WITH A LOCKING PROJECTION AND A RESILIENT FINGER

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/075,146

(22) Filed: Mar. 10, 2008

(65) Prior Publication Data

US 2008/0220654 A1 Sep. 11, 2008

(30) Foreign Application Priority Data

Mar. 9, 2007 (CN) ..... 2007 2 0035285

(51) Int. Cl.
*H01R 13/62* (2006.01)

(52) U.S. Cl. ..... 439/157; 439/160

(58) Field of Classification Search ..... 439/157, 439/160, 328

See application file for complete search history.

(56) References Cited

U.S. PATENT DOCUMENTS 5,389,000 A * 2/1995 DiViesti et al. ..... 439/157
5,445,531 A * 8/1995 Billman et al. ..... 439/160
5,511,985 A 4/1996 Noschese et al.
5,660,552 A 8/1997 Suzuki et al.
6,503,093 B1 * 1/2003 Sakata et al. ..... 439/328
6,802,732 B1 10/2004 Bu et al.
7,494,354 B2 * 2/2009 Mon et al. ..... 439/160

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

A card edge connector (100) for receiving a memory card (200) includes an insulative housing (1) and a number of terminals (2) retained therein. The insulative housing (1) includes an elongated base (10) extending along a longitudinal direction thereof and a pair of tower section (18) extending upwardly from opposite ends of the base (10). The base (10) defines a receiving slot (10) for receiving the memory card (200) and two rows of contact receiving channels (111) communicated with the slot (10). Each tower section (18) includes a pair of opposed arms (13) and a cavity (15) located therebetween. The arm (13) has a cantilever type resilient finger (132) formed from an inner wall of the arm (13) and extending downwardly for sandwiching the memory card (200), and a locking projection (131) at an upper portion thereof to engage with a notch (203) of the memory card (200).

18 Claims, 5 Drawing Sheets

CARD EDGE CONNECTOR WITH A LOCKING PROJECTION AND A RESILIENT FINGER

BACKGROUND OF THE INVENTION

1. Field of the Invention

The present invention relates to a card edge connector, and more particularly to a card edge connector with a pair of improved resilient fingers and locking projections molded integrally with an insulative housing of the card edge connector for locking the memory card.

2. Description of Related Art

Card edge connectors are employed widely with computers to receive an memory card having a mating edge and a plurality of contact pads coupled to the edge and a notch in side edge. Such card edge connectors have an elongated base defining an elongated slot for receiving the mating edge of the memory card and a pair of arms extending upwardly from opposite sides of the base. Each arm defines a cavity for receiving the side edge of the memory card. A plurality of terminals retained in the insulative housing and each comprises a contact portion extending into the slot for engaging with the contact pads of the memory card and a solder tail extending out of the insulative housing for connecting with a circuit board.

However, the opposite inside walls of the cavity rigidly and mechanically sandwich the side edge of the memory card after the memory card inserted into the card edge connector, whereby the engagement between the memory card and the card edge connector may be affected adversely during the memory card being shocked or vibrated. In addition, the card edge connector usually comprises an ejector with a locking portion to lock with the notch of the memory card for avoiding the movement of the memory card, thereby increasing the cost of the manufacture and the assembly.

Hence, a card edge connector is desired to overcome the disadvantage of the prior art.

BRIEF SUMMARY OF THE INVENTION

According to one aspect of the present invention, a card edge connector for receiving a memory card comprises an insulative housing and a plurality of terminals retained therein. The insulative housing comprises an elongated base extending along a longitudinal direction thereof and a pair of tower sections extending upwardly from opposite ends of the base. The base defines a receiving slot for receiving the memory card and two rows of contact receiving channels communicated with the receiving slot. The tower section comprises a pair of opposed arms and a cavity located therebetween to receive a side edge of the memory card. Each arm has a cantilever type resilient finger for sandwiching the memory card and a locking projection to lock a notch of the memory card. Each terminal has a contact portion exposed in the slot and a solder tail extending out of the insulative housing.

According to another aspect of the present invention, a card edge connector comprises an insulative housing having an elongated base extending along a longitudinal direction thereof and a pair of tower sections extending upwardly from opposite ends of the base. The base defines a card edge receiving slot and two rows of contact receiving channels communicated with the slot. Each tower section comprises a pair of opposed arms and an end portion separating from the pair of arms. Each arm has a cantilever type resilient finger extending downwardly from an inner wall of the arm and a locking projection at an upper portion thereof. A plurality of terminals received in the corresponding channels and each has a contact portion exposed in the slot and a solder tail extending out of the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
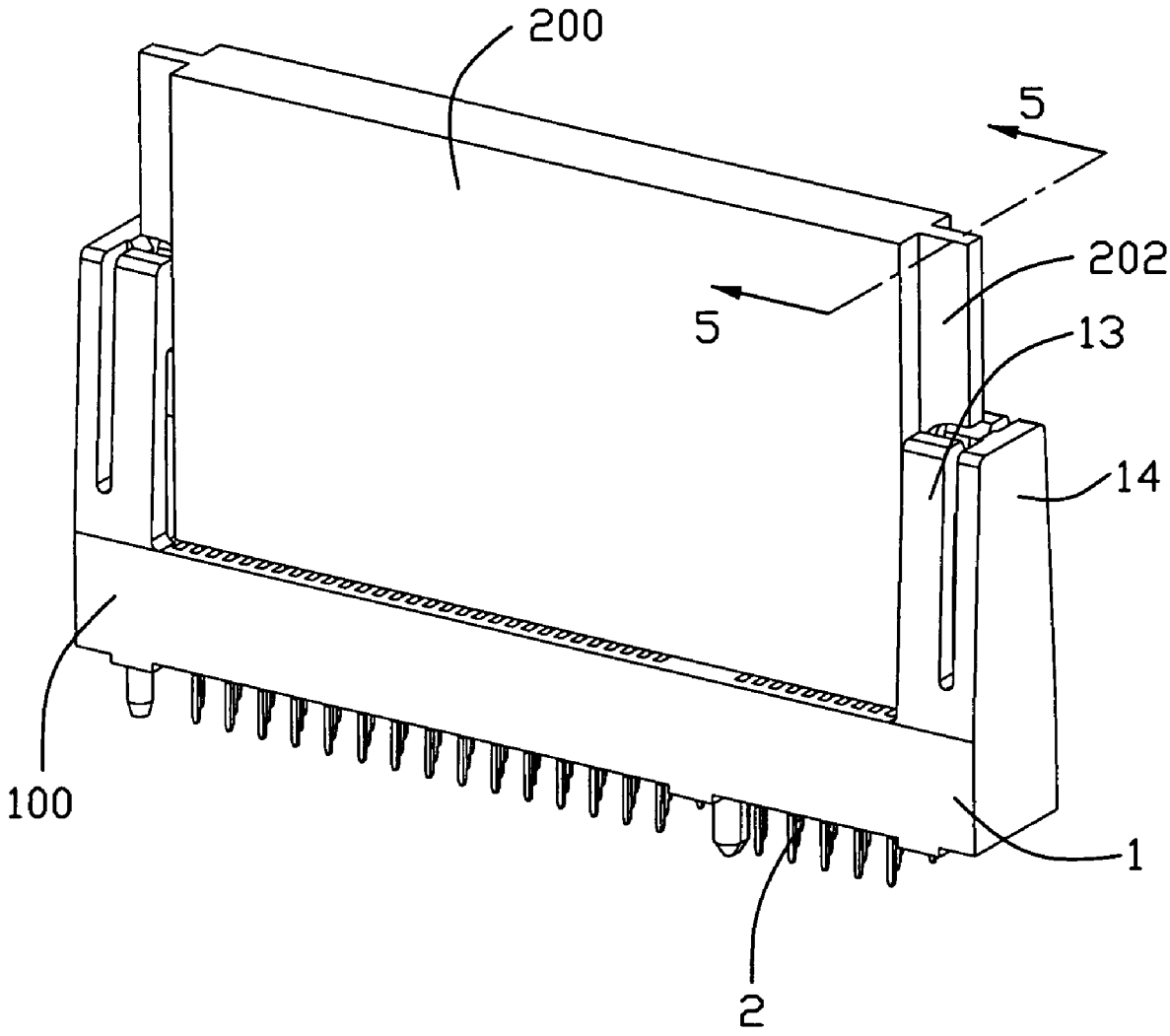
FIG. 1 is a perspective view of the preferred embodiment of a card edge connector and a memory card according to the present invention.
Figure 2:
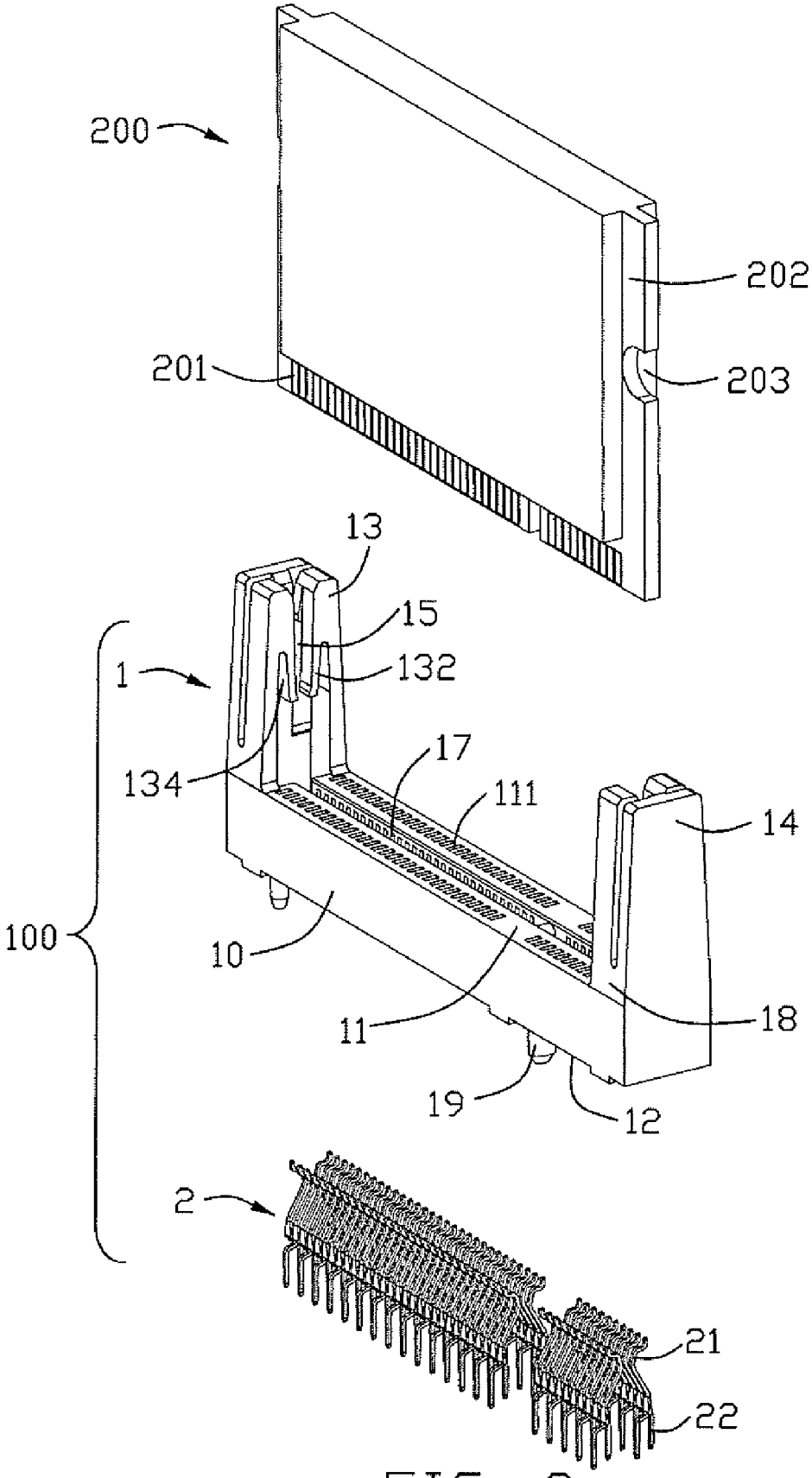
FIG. 2 is an exploded perspective view of the card edge connector and the memory card shown in FIG. 1.
Figure 3:
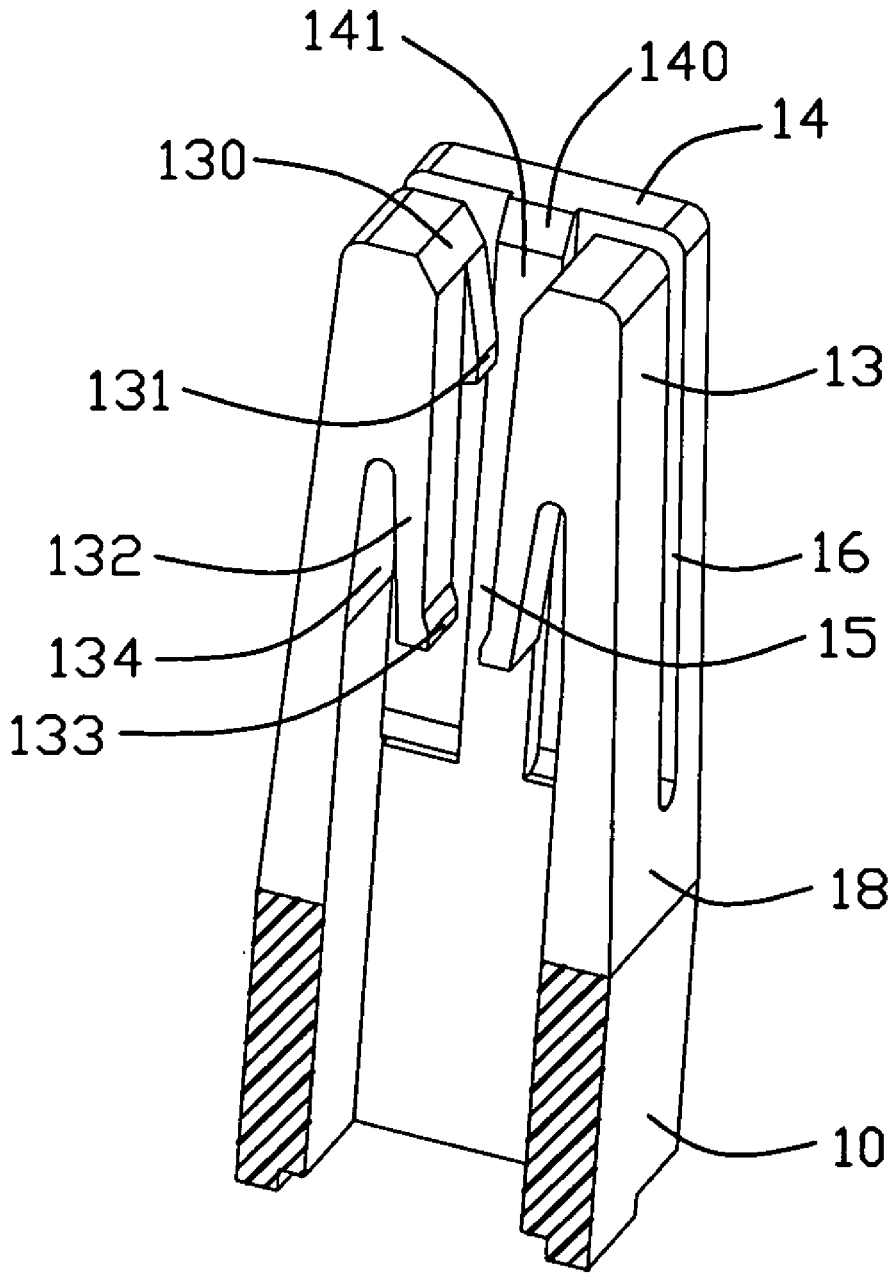
FIG. 3 is a partial perspective view of the card edge connector shown in FIG. 1.
Figure 4:
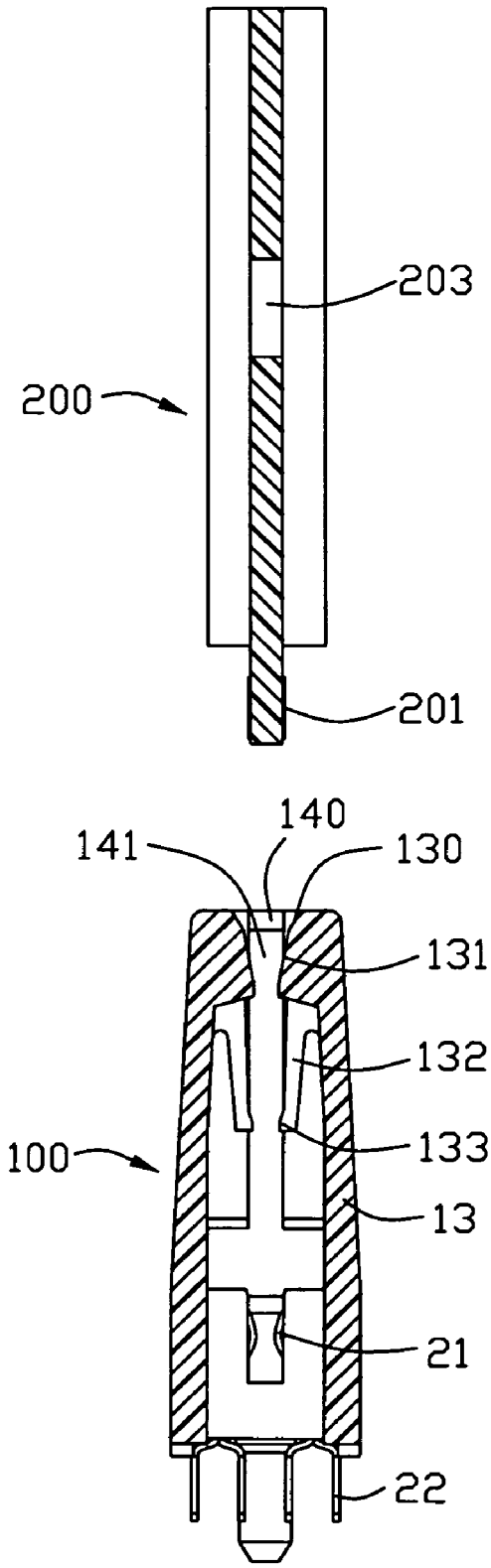
FIG. 4 is a cross-sectional view of the card edge connector and the memory card showing the memory card not inserted into the card edge connector.
Figure 5:
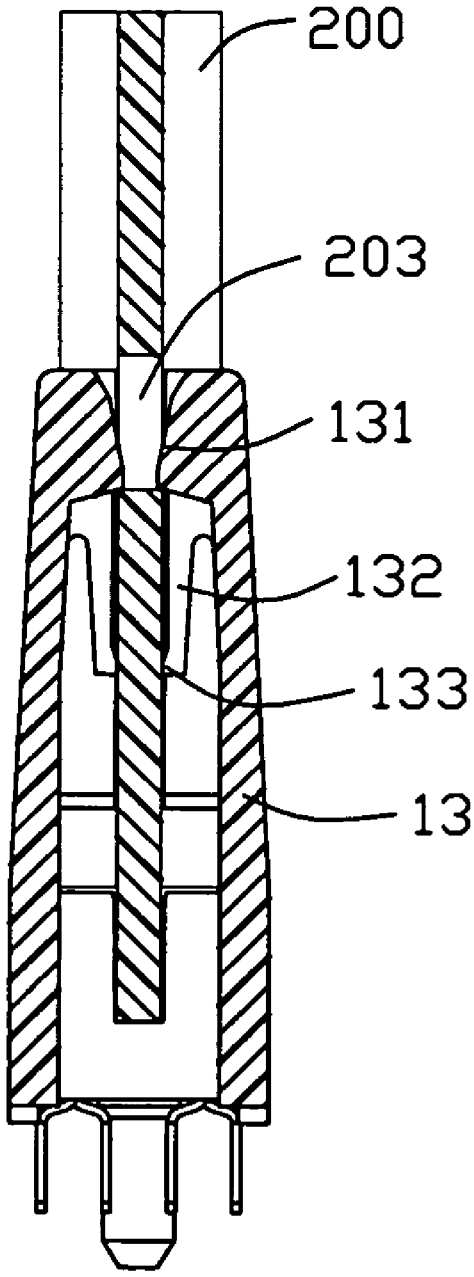
FIG. 5 is a cross-sectional view of the card edge connector and the memory card showing the memory card inserted into the card edge connector.

Referring to FIGS. 1-5, a card edge connector 100 for receiving a memory card 200 is disclosed in accordance with the present invention. The card edge connector 100 comprises an insulative housing 1 and a plurality of terminals 2 retained in the insulative housing 1. The memory card 200 has a bottom edge with a plurality of contact pads 201 coupled thereon and a pair of opposite side edges 202. Each side edge 202 defines a notch 203.

The insulative housing 1 comprises an elongated base 10 extending along a longitudinal direction thereof and a pair of tower sections 18 extending upwardly from opposite ends of the base 10 and perpendicular to the longitudinal direction. Two tower sections 18 are symmetrical with each other. The base 10 has a pair of side walls 11 and a bottom wall 12. A card edge receiving slot 17 is formed between the side walls 11 and extends along the longitudinal direction to receive the bottom edge of the memory card 200. Each side wall 11 defines a plurality of contact receiving channels 111 communicated with the receiving slot 17. The insulative housing 1 has a pair of posts 16 extending downwardly from the bottom wall 12 for positioning the card edge connector 100 to a circuit board (not shown). Each terminal 2 has a contact portion 21 exposed into the receiving slot 17 to contact with the contact pads 201 of the memory card 200 and a solder tail 22 extending out of the bottom wall 12.

Each tower section 18 comprises a pair of arms 13 extending upwardly from two sides thereof and an end portion 14 extending upwardly from one end of the base 10. The end portion 14 is perpendicular to the arms 13 and the base 10. A cavity 15 is formed between the arms 13 to receive the side edges 202 of the memory card 200 and communicates with the receiving slot 17. A pair of slits 16 are formed between the arms 13 and the end portion 14 for making the arms 13 elastic. The end portion 14 has a rib 141 projecting into the cavity 15 for abutting against the side edge 202 of the memory card 200. The arms 13 and the end portion 14 are all formed with lead-in portions 130, 140 at a top portion thereof for leading the memory card 200 inserted into the card edge connector 100.

Each arm 13 has a locking projection 131 projecting into the cavity 15 from an inner wall thereof and located at an upper portion thereof. The locking projections 131 are adapted to engage with the notch 203 for making an interference gripping with the memory card 200 inserted into the receiving slot 17. The locking projections 131 present as wedge-shaped to facilitate the memory card 200 inserting or drawing. A pair of cantilever type resilient fingers 132 are integrally formed with the arms 13 and extending into the cavity 15. A plurality of slits 134 are defined between the resilient fingers 132 and the corresponding arms 13 for providing the resilient fingers 132 a space to flex. Each pair of resilient fingers 132 are formed with a pair of protrusions 133 extending toward each other at a distal thereof. The locking projection 131 is staggered with the resilient finger 132 along an up to down direction of the arm 13.

According to the present invention, when the memory card 200 is inserted into the card edge connector 100, the bottom edge is received in the receiving slot 17 to connect with the terminals 2 of the card edge connector 100. The side edge 202 of the memory card 200 is received in the cavity 15 and abuts against the rib 141 of the end portion 14. The protrusions 133 of the resilient fingers 132 sandwich the side edge 202 of the memory card 200 for providing the memory card 200 a function of shock absorption to ensure the signal transmission between the memory card 200 and the card edge connector 100. At the same time, the locking projections 131 engage with the notches 203 for avoiding the memory card 200 moving upwardly. In addition, the card edge connector 100 has a simple structure and can decrease the cost of the manufacture and the assembly.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector for receiving a memory card with a notch, comprising:

an insulative housing comprising an elongated base extending along a longitudinal direction thereof and a pair of tower sections extending upwardly from opposite ends of the base, the base defining a receiving slot for receiving the memory card and two rows of contact receiving channels communicated with the receiving slot, each tower section comprising a pair of opposed arms and a cavity located therebetween, each arm is integrally formed with a cantilever type resilient finger for sandwiching the card and a locking projection to lock with the notch of the memory card; and a plurality of terminals received in the corresponding channels and each comprising a contact portion exposed in the receiving slot and a solder tail extending out of the insulative housing.

2. The card edge connector according to claim 1, wherein the locking projection is projecting from the inner side of the arm and located at an upper portion, the locking projection being staggered with the resilient finger along an up to down direction of the arm.

3. The card edge connector according to claim 1, wherein the resilient finger extends downwardly from the arm and comprises a protrusion at a lower end thereof.

4. The card edge connector according to claim 1, wherein the resilient finger and the arm define a slit therebetween.

5. The card edge connector according to claim 1, wherein each arm has a lead-in portion at a top portion thereof to lead the memory card into the cavity.

6. The card edge connector according to claim 1, wherein each tower section has an end portion extending upwardly to lead the memory card inserted into the receiving slot rightly.

7. The card edge connector according to claim 6, wherein the end portion and the pair of arms define a pair of slits therebetween.

8. A card edge connector, comprising:

an insulative housing comprising an elongated base extending along a longitudinal direction thereof and a pair of tower sections extending upwardly from two ends of the base, the base defining a card edge receiving slot and two rows of contact receiving channels communicated with the receiving slot, each tower section comprising a pair of opposed arms and an end portion separating from the pair of arms, each arm is integrally formed with a cantilever type resilient finger formed from an inner wall of the arm and extending downwardly and a locking projection at an upper portion thereof; and a plurality of terminals received in the corresponding channels and each comprising a contact portion exposed in the receiving slot and a solder tail extending out of the insulative housing.

9. The card edge connector according to claim 8, wherein the locking projection is projecting inwardly from the arm and higher than the resilient finger.

10. The card edge connector according to claim 8, wherein the resilient finger is formed with a protrusion at a lower end thereof.

11. The card edge connector according to claim 8, wherein each arm and the resilient finger thereof define a slit therebetween.

12. The card edge connector according to claim 8, wherein the end portion and the aims define a cavity therebetween.

13. The card edge connector according to claim 12, wherein the end portion has a rib projecting into the cavity.

14. An electrical connector comprising:

an insulative housing defining a central slot along a longitudinal direction thereof a plurality of terminals disposed in the housing arid by two sides of the central slot;

a pair of towers located at two opposite longitudinal ends of the housing, etch of the towers including unitarily an end wall facing the central slot and a pair of resilient arms spaced by the corresponding end wail with therebetween a gap in the longitudinal direction and respectively by two sides of the central slot, each of said resilient arms defining a rigid locking projection and a resilient cantilever finger with an engagement end thereof; wherein said engagement end and said rigid locking projection are offset from each other in both a vertical direction and said longitudinal direction; wherein both said rigid locking projection and said engagement end protrudes toward the central slot in a transverse direction perpendicular to both said longitudinal direction and said vertical direction.

15. The electrical connector as claimed in claim 14, wherein said resilient cantilever finger extends downwardly with a downward slit between said resilient cantilever finger and the corresponding resilient arm.

16. The electrical connector as claimed in claim 14, wherein said engagement end is lower than the corresponding locking projection.

17. The electrical connector as claimed in claim 14, wherein said engagement end is configured and dimensioned to abut against a printed circuit board.

18. The electrical connector as claimed in claim 17, wherein said locking projection is configured and dimensioned to be received in a notch of said printed circuit board.

* * * * *